US011703042B2

(12) United States Patent
Chong et al.

(10) Patent No.: US 11,703,042 B2
(45) Date of Patent: Jul. 18, 2023

(54) SUCTION MUFFLER FOR RECIPROCATING COMPRESSOR

(71) Applicant: Panasonic Appliances Refrigeration Devices Singapore, Singapore (SG)

(72) Inventors: San Haw Chong, Singapore (SG); Zhen Chyen Lau, Singapore (SG)

(73) Assignee: Panasonic Appliances Refrigeration Devices Singapore, Singapore (SG)

( * ) Notice: Subject to any disclaimer, the term of this patent is extended or adjusted under 35 U.S.C. 154(b) by 41 days.

(21) Appl. No.: 17/442,673

(22) PCT Filed: Mar. 30, 2020

(86) PCT No.: PCT/SG2020/050189
§ 371 (c)(1),
(2) Date: Sep. 24, 2021

(87) PCT Pub. No.: WO2020/204825
PCT Pub. Date: Oct. 8, 2020

(65) Prior Publication Data

US 2022/0163026 A1 May 26, 2022

(30) Foreign Application Priority Data

Mar. 29, 2019 (SG) ..... 10201902841Y

(51) Int. Cl.
*F04B 39/00* (2006.01)
*F04C 29/06* (2006.01)

(52) U.S. Cl.
CPC ..... *F04B 39/0061* (2013.01); *F04B 39/0072* (2013.01); *F04C 29/065* (2013.01); *Y10S 181/403* (2013.01)

(58) Field of Classification Search
CPC .. Y10S 181/403; F04C 29/065; F04C 29/068; F04B 39/0061; F04B 39/0072
See application file for complete search history.

(56) References Cited

U.S. PATENT DOCUMENTS

RE30,034 E * 6/1979 Serratto ..... F24F 1/01 165/123
5,733,106 A * 3/1998 Lee ..... F04B 39/0072 181/403

(Continued)

FOREIGN PATENT DOCUMENTS

CN 103477048 B * 8/2016 ..... F01D 1/22

OTHER PUBLICATIONS

Written Opinion of the International Searching Authority for PCT/SG2020/050189.

(Continued)

*Primary Examiner* — Dominick L Plakkoottam
(74) *Attorney, Agent, or Firm* — JCIP; Joseph G. Chu; Jeremy I. Maynard

(57) ABSTRACT

A suction muffler for a reciprocating compressor comprises a first housing portion and a second hosing portion. The first housing portion comprising a first inlet opening, and a second inlet opening. The second housing portion comprises a blocking member configured to block one of a first refrigerant flow path from the first inlet opening to a suction muffler outlet and a second refrigerant flow path from the second inlet opening to the suction muffler outlet. The blocking member can be provided in different configurations by a selection of the second housing portion or by configuring the relative arrangement of the first housing portion and the second housing portion.

10 Claims, 11 Drawing Sheets

(56) References Cited

U.S. PATENT DOCUMENTS

| | | | | |
|---|---|---|---|---|
| 7,837,449 | B2 * | 11/2010 | Tadano | F01C 21/0809 418/248 |
| 8,246,320 | B2 | 8/2012 | Park et al. | |
| 9,011,121 | B2 | 4/2015 | Yokoyama et al. | |
| 9,200,627 | B2 * | 12/2015 | Fagotti | F04B 39/0061 |
| 2003/0127282 | A1 * | 7/2003 | Lee | F04C 29/068 181/262 |
| 2009/0175741 | A1 * | 7/2009 | Jost | F25B 31/002 417/312 |
| 2018/0224183 | A1 * | 8/2018 | Besore | F25D 17/065 |
| 2020/0102856 | A1 * | 4/2020 | McDeed | F01N 3/103 |

OTHER PUBLICATIONS

International Preliminary Report on Patentability from the International Preliminary Examining Authority for PCT/SG2020/050189.
International Search Report of the International Searching Authority for PCT/SG2020/050189.

* cited by examiner

SUCTION MUFFLER FOR RECIPROCATING COMPRESSOR

TECHNICAL FIELD

The present disclosure relates to reciprocating compressors and in particular to suction mufflers for reciprocating compressors.

BACKGROUND

Appliances such as refrigerators and freezers typically comprise reciprocating compressors which are configured to compress a refrigerant as part of a refrigeration cycle. In such an arrangement, the reciprocating compressor is housed within a hermetically sealed shell. Low pressure, low temperature refrigerant is introduced into the shell through a suction pipe on the outside of the compressor. The refrigerant is then introduced into a suction muffler which is provided to reduce noise caused by pulsation inside a compression chamber of the reciprocating compressor. To maintain a low temperature of the refrigerant, the suction muffler inlet is located near to the location of the suction pipe on the shell of the reciprocating compressor.

However due to a variety of appliance designs, the position of the suction pipe often varies. This introduces a requirement to change the suction muffler design to provide the suction muffler inlet in a position corresponding to the position of the suction pipe on the shell.

SUMMARY

According to an aspect of the present disclosure, a suction muffler for a reciprocating compressor comprises a first housing portion and a second housing portion. The first housing portion has a first inlet opening, and a second inlet opening. The second housing portion comprising a blocking member which is configured to block one of a first refrigerant flow path from the first inlet opening to a suction muffler outlet and a second refrigerant flow path from the second inlet opening to the suction muffler outlet.

By selectively configuring the blocking member, the first inlet opening or the second inlet opening can be selected as the suction muffler inlet. In some embodiments both the first inlet opening and the second inlet opening can be selected as the suction muffler inlet concurrently.

In some embodiments, the second housing portion is selected from a plurality of possible second housing portions. The plurality of possible second housing portions having blocking members provided in different configurations.

In some embodiments, the second housing portion can be coupled to the first housing portion in a plurality of different configurations.

The blocking member may be configured to block either the first inlet opening or the second inlet opening.

In an embodiment the first housing portion comprises a ring shaped portion comprising two potential refrigerant flow paths from the first inlet opening to the suction muffler outlet and two possible flow paths from the second inlet opening to the suction muffler outlet and wherein the blocking member is configured to block one of the potential paths from the first inlet opening to the suction muffler outlet and one of the potential paths from the second inlet opening to the suction muffler outlet.

The suction muffler outlet may be provided on the first housing portion. The first housing portion may be a muffler body portion. The second housing portion may be a muffler cover portion.

According to an aspect of the present disclosure a reciprocating compressor is provided comprising a suction muffler. The suction muffler may comprise a ring shaped channel portion arranged around an electromotive element of the reciprocating compressor.

BRIEF DESCRIPTION OF THE DRAWINGS

In the following, embodiments of the present invention will be described as non-limiting examples with reference to the accompanying drawings in which.

DETAILED DESCRIPTION

The present disclosure relates to suction mufflers for hermetically sealed reciprocating compressors. In hermetically sealed reciprocating compressor, it is advantageous to provide suction muffler with an inlet which is close to location on the interior of the shell of the hermetically sealed reciprocating compressor corresponding to the inlet pipe on the exterior of the shell. The reason for this is that low pressure refrigerant enters the shell of the compressor at low temperature and it is desirable for this low temperature refrigerant to enter the suction muffler and therefore the compression chamber of the compressor with minimal mixing and contact with higher temperature refrigerant and components of the compressor.

Figure 1A:
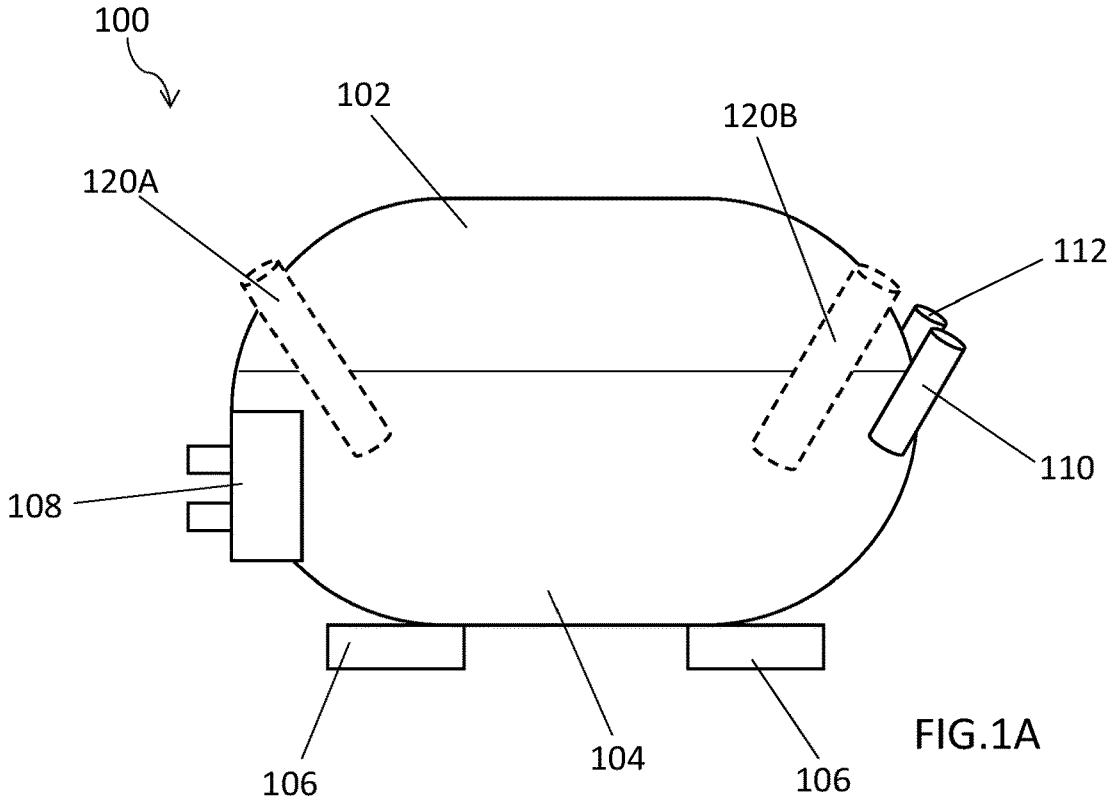
FIG. 1A is a side view of a reciprocating compressor showing possible suction pipe locations.
Figure 1B:
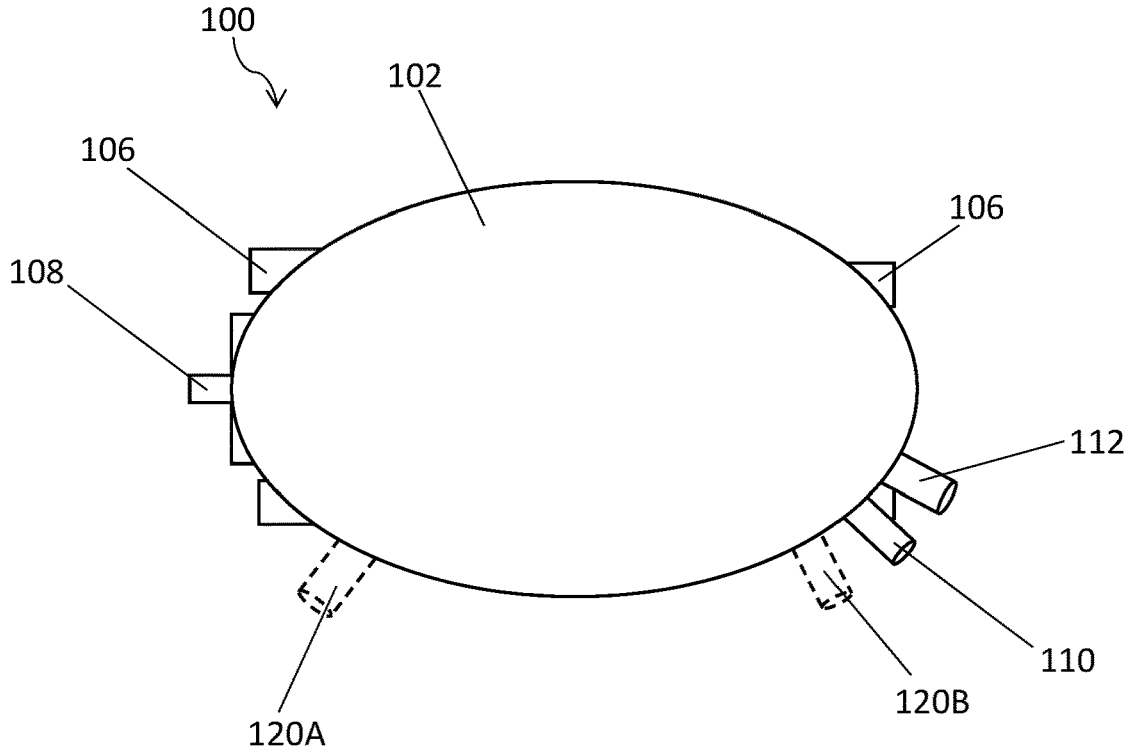
FIG. 1B is a top view of a reciprocating compressor showing possible suction pipe locations.

However, the design of an appliance such as a refrigerator or freezer may place constraints on the location of the inlet pipe on the shell of the compressor. For example, some appliance designs may require the inlet pipe to be located close to the terminal of the compressor where electrical connections to supply power to the electromotive element within the shell of the compressor. Other designs may require the inlet pipe to be located at the opposite side to the terminal. FIG. 1A and FIG. 1B show possible suction pipe locations.

FIG. 1A is a side view of a reciprocating compressor showing possible suction pipe locations. As shown in FIG. 1A, the reciprocating compressor 100 is housed within a shell which comprises an upper shell part 102 and a lower shell part 104. The shell hermetically seals the reciprocating compressor 100. The lower shell part 104 is attached to four feet 106 through which the compressor 100 can be attached within an appliance such as a refrigerator. A terminal 108 is provided on the lower shell part 104. The terminal 108 allows electrical connection to an electromotive component of the reciprocating compressor 100. A discharge pipe 110 and a process pipe 112 are provided on the lower shell part 104 at an opposite end to the terminal 108. FIG. 1A shows two possible positions for a suction pipe. A first suction pipe position 120A is on the lower shell part 104, adjacent to the terminal 108. A second suction pipe position 120B is on the lower shell part 104 at an opposite end to the terminal 108 and close to the discharge pipe 110.

FIG. 1B is a top view of a reciprocating compressor showing possible suction pipe locations. As shown in FIG. 1B, the upper shell part 102 is substantially oval when viewed from above. The terminal 108 is arranged at one end of a major axis of the oval. The discharge pipe 110 and the process pipe 112 are close to the opposing end of the major axis of the oval and at an angle of between 30 and 45 degrees from the major axis when viewed from above. The feet 106 are arranged with two feet 106 at each end of the reciprocating compressor 100.

As shown in FIG. 1B, the first suction pipe position 120A is adjacent to the terminal 108 at an angle of around 60 degrees from the major axis and the terminal 108. The second suction pipe position 120B is at the opposite end of the reciprocating compressor 100 from the terminal 108 at an angle of around 60 degrees from the major axis.

Figure 2:
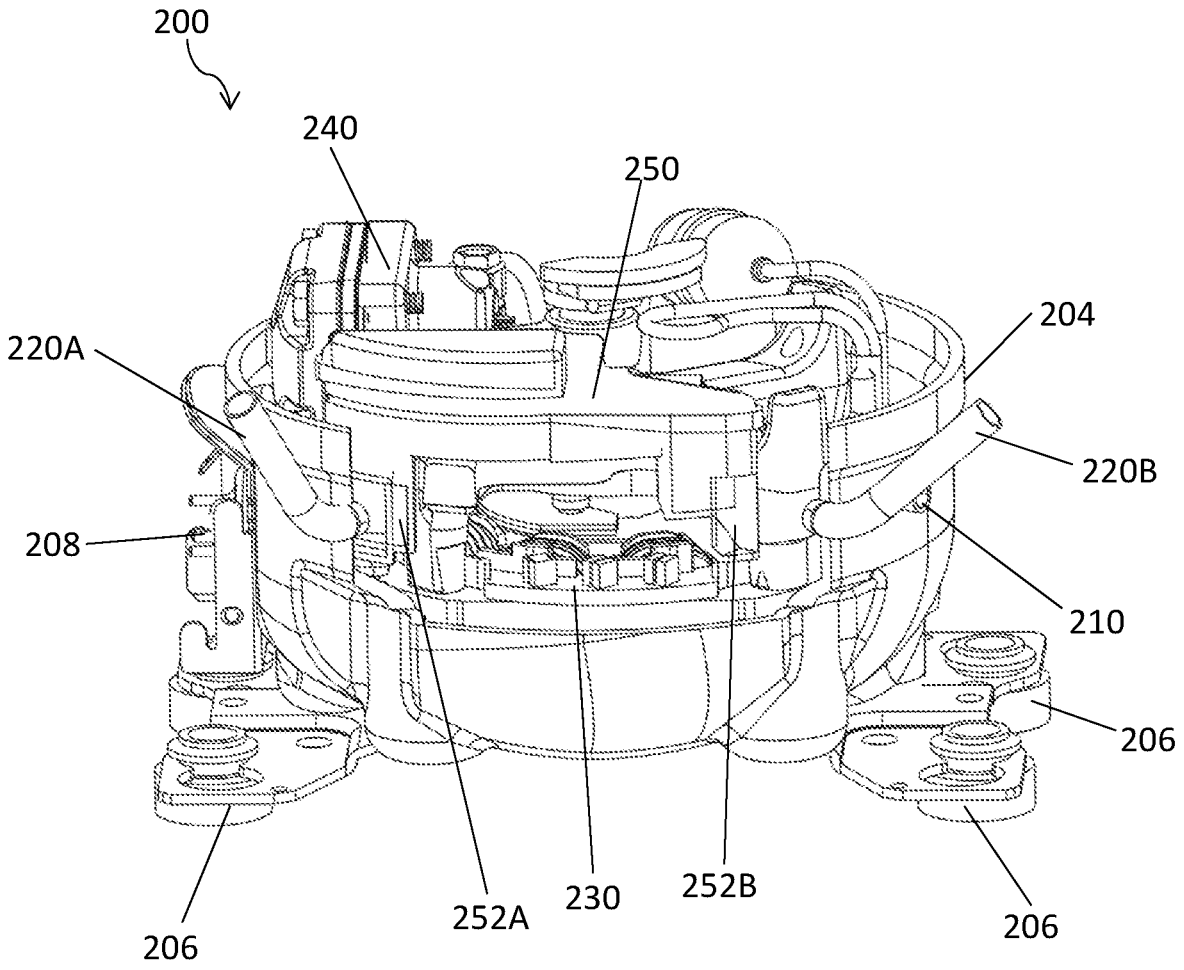
FIG. 2 is a cut away view of a reciprocating compressor comprising a suction muffler according to a first embodiment of the present invention.

FIG. 2 is a cut away view of a reciprocating compressor comprising a suction muffler according to an embodiment of the present invention. The reciprocating compressor 200 is hermetically enclosed within a shell formed form an upper shell part and a lower shell part 204. The upper shell part is not shown in FIG. 2. As in the reciprocating compressor 100 shown in FIG. 1A and FIG. 1B, the lower shell part 204 is attached to four feet 206 through which the compressor 200 can be attached within an appliance such as a refrigerator. A terminal 208 is provided at one end of the shell on the lower shell part 204. As shown in FIG. 2, a discharge pipe 210 is provided on the lower shell part 204 at the opposite end to the terminal 208. FIG. 2 also shows two possible positions for a suction pipe. A first suction pipe position 220A is on the lower shell part 204, adjacent to the terminal 208. A second suction pipe position 220B is on the lower shell part 204 at an opposite end to the terminal 208 and close to the discharge pipe 210. The locations of the terminal 208, the discharge pipe 210, the first suction pipe position 220A and the second suction pipe position 220B are as described above with reference to FIG. 1A and FIG. 1B.

The reciprocating compressor 200 comprises an electromotive component 230 and a compression component 240 arranged within the shell. The electromotive component 230 comprises a rotor and a stator. The compression component 240 comprises a piston arranged to reciprocate within a cylinder formed from a cylinder block. The electromotive element 230 is configured to drive a crankshaft. The crankshaft has an eccentric shaft portion which is coupled to the piston by a connecting rod. When the rotor of the electromotive component 230 is caused to rotate by application of an electric current to the terminal 208, this causes the crankshaft to rotate. The eccentric shaft portion of the crankshaft and the connecting rod convert this rotational motion into reciprocating motion of the piston in the cylinder of the compression component. The reciprocation cycle of the compressor comprises two strokes: a suction stroke and a compression stroke. The suction stroke occurs as the piston moves outwards from the cylinder. During the suction stroke, a suction valve opens, and refrigerant is drawn into the cylinder from the suction pipe. During the compression stroke, the piston moves into the cylinder and the refrigerant in the cylinder is compressed. Towards the end of the compression stroke, a discharge valve opens, and the compressed refrigerant is discharged through the discharge pipe 210.

As shown in FIG. 2, the reciprocating compressor 200 comprises a suction muffler 250. The suction muffler 250 as two suction muffler inlet openings: a first inlet opening 252A faces the first suction pipe position 220A on the lower shell part 204 and a second suction muffler opening 252B faces the second suction pipe position 220B on the lower shell part 204.

Refrigerant that is drawn into the cylinder from a suction pipe travels through the suction muffler 250 before entering the compression component 240 of the reciprocating compressor 200. The suction muffler 250 acts to reduce noise due to pulsations from the drawing of refrigerant into the compression component 240.

As will be described in more detail below, the suction muffler 250 can be assembled in different configurations. In a first configuration, the first inlet opening 252A is configured to function as a suction muffler inlet and a refrigerant path from the second inlet opening 252B to a suction muffler outlet is blocked. In a second configuration, the second inlet opening 252B is configured to function as a suction muffler opening a refrigerant path from the first inlet opening 252A to the suction muffler outlet is blocked.

Thus, the first configuration of the suction muffler 250 can be used in a reciprocating compressor which has a suction pipe located at the first suction pipe position 220A and the second configuration of the suction muffler 250 can be used in a reciprocating compressor which has a suction pipe located at the second suction pipe position 220B.

Figure 3A:
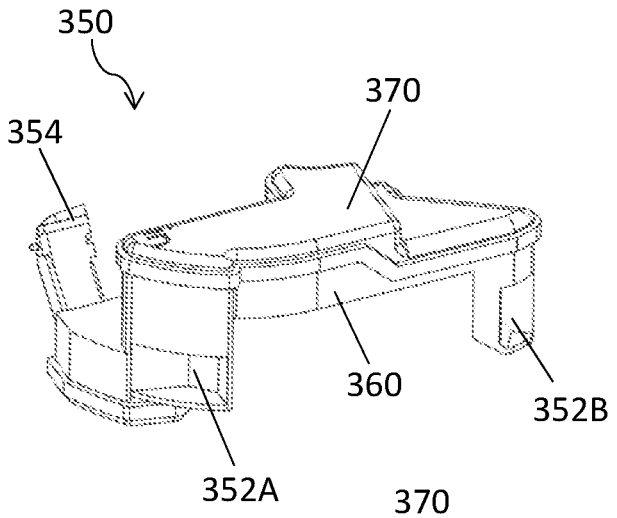
FIGS. 3A to 3C show a suction muffler according to a first embodiment of the present invention assembled in a first configuration.

FIG. 3A shows a suction muffler according to a first embodiment of the present invention assembled in a first configuration. As shown in FIG. 3A, the suction muffler 350 is formed from a first housing portion 360 and a second housing portion 370. The first housing portion 360 forms the body of the suction muffler 350 and as a first inlet opening 352A, a second inlet opening 352B and a suction muffler outlet 354. The second housing portion 370 forms a muffler cover.

Figure 3B:
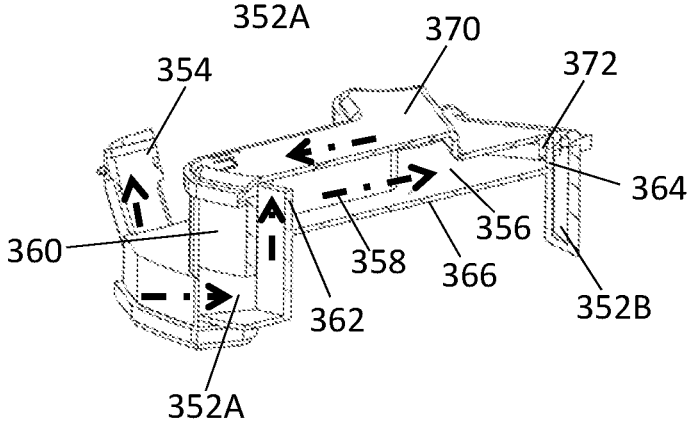

FIG. 3B is a cut away view of the suction muffler according to the first embodiment of the present invention assembled in the first configuration. As shown in FIG. 3B, the first housing portion 360 comprises internal walls. A first inlet opening internal wall 362 forms a passageway from the first inlet opening 352A towards a muffling space 356. The muffling space 356 is enclosed by the first housing portion 360 and the second housing portion 370. The first inlet opening wall 362 extends upwards from a floor 366 of the first housing portion 360. As shown in FIG. 3B, the first inlet opening wall 362 does not extend all of the way to the cover formed from the second housing portion 370. Thus there is a gap over the first inlet opening wall 362 that forms part of a first refrigerant flow path 358.

The first refrigerant flow path 358 runs from the first inlet opening 352A through the gap between the first inlet opening wall 362 and the cover provided by the second housing portion 370, through the muffling space 356, through an outlet channel to the suction muffler outlet 354.

A second inlet opening internal wall 364 forms a passageway from the second inlet opening 352B towards the muffling space 356. The second opening wall 364 extends upwards from the floor 366 of the first housing portion 360. As shown in FIG. 3B, a blocking member 372 protrudes downwards from the cover formed from the second housing portion 370. Thus, when the suction muffler 350 is assembled in the first configuration there is no flow path from the second inlet opening 352B to the muffling space 356. The blocking member 372 is formed from two ridges which extend downwards from the second housing portion 370. The top of the second opening wall 364 fits into this gap.

The suction muffler 350 is assembled by gluing or welding the first housing portion 360 and the second housing portion 370 such that a seal is formed where the two parts are joined together. Thus, seal is formed between the blocking member 372 and the second inlet opening wall 364. Therefore, in the suction muffler 350 assembled in the first configuration, the first inlet opening 352A acts as a suction muffler inlet and the second inlet opening 352B does not form part of a refrigerant flow path.

Figure 3C:
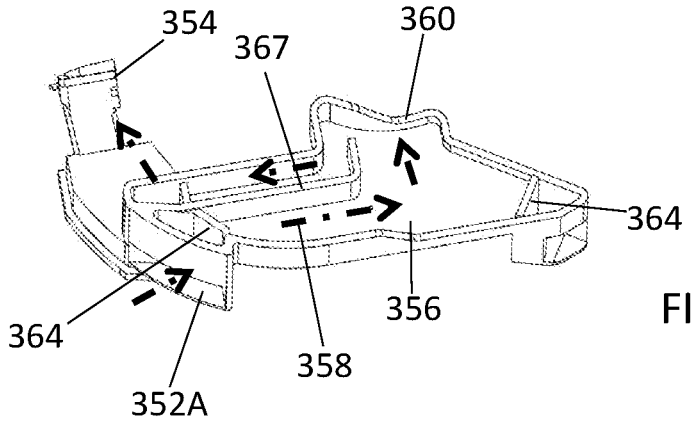

FIG. 3C shows the refrigerant flow path in the suction muffler according a first embodiment of the present invention when assembled in the first configuration. As shown in FIG. 3C, a rear internal wall 367 is provided which runs parallel to the back of the first housing portion 360. The refrigerant flow path 358 runs through the first inlet opening 352A, and into the muffling space 356 through the gap over the first inlet opening wall 362. The refrigerant flow path 358 runs through the muffling space 356 into a channel formed by the rear internal wall 367 and out of the suction muffler outlet 354.

Figure 4A:
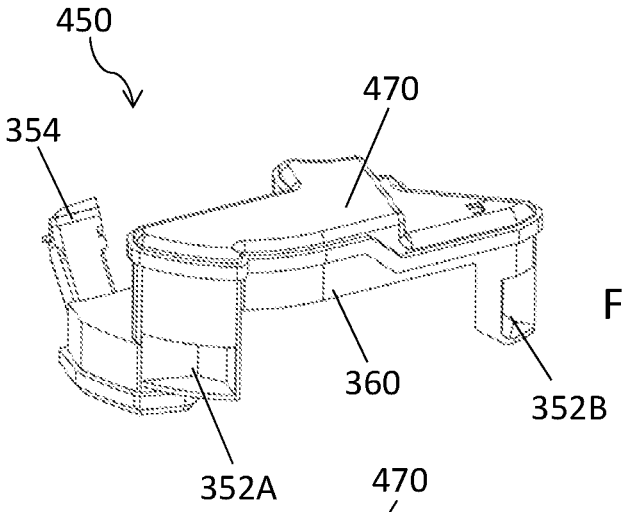
FIGS. 4A to 4C show a suction muffler according to a first embodiment of the present invention assembled in a second configuration.

FIG. 4A shows a suction muffler according to a first embodiment of the present invention assembled in a second configuration. As shown in FIG. 4A, the suction muffler 450 is formed from a first housing portion 360 and a second housing portion 470. The first housing portion 360 is the same as the first housing portion 360 described above with reference to FIG. 3A to FIG. 3C. The first housing portion 360 forms the body of the suction muffler 350 and as a first inlet opening 352A, a second inlet opening 352B and a suction muffler outlet 354. The second housing portion 470 is configured differently from the second housing portion 370 in the first configuration. The second housing portion 470 forms a muffler cover.

Figure 4B:
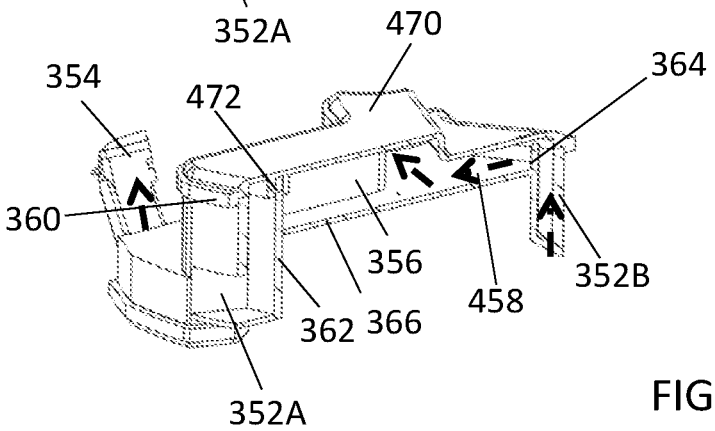

FIG. 4B is a cut away view of the suction muffler according to the first embodiment of the present invention assembled in the second configuration. As mentioned above, the first housing portion 360 is as described above with reference to FIG. 3B. The first housing portion 360 comprises internal walls. A first inlet opening internal wall 362 forms a passageway from the first inlet opening 352A towards a muffling space 356. The muffling space 356 is enclosed by the first housing portion 360 and the second housing portion 470. The first inlet opening wall 362 extends upwards from a floor 366 of the first housing portion 360.

In the second configuration, as shown in FIG. 4B, the cover formed from the second housing portion 470 has a blocking member 472 which protrudes downwards from the second housing portion 470. Thus, in the second configuration when the suction muffler 450 is assembled there is no flow path from the first inlet opening 352A to the muffling space 356. The blocking member 472 is formed from two ridges which extend downwards from the second housing portion 470. The top of the first opening wall 362 fits into this gap.

In the second configuration, the second inlet opening wall 364 does not extend all of the way to the cover formed from the second housing portion 470. Thus there is a gap over the second inlet opening wall that forms part of a second refrigerant flow path 458. The second refrigerant flow path 458 runs from the second inlet opening 352B through the gap between the second inlet opening wall 364 and the muffler cover provided by the second housing portion 470, through the muffling space 356, through an outlet channel to the suction muffler outlet 354.

The suction muffler 450 is assembled by gluing or welding the first housing portion 360 and the second housing portion 470 such that a seal is formed where the two parts are joined together. Thus, seal is formed between the blocking member 472 and the first inlet opening wall 362. Therefore, in the suction muffler 450 assembled in the second configuration, the second inlet opening 352B acts as a suction muffler inlet and the first inlet opening 352A does not form part of a refrigerant flow path.

Figure 4C:
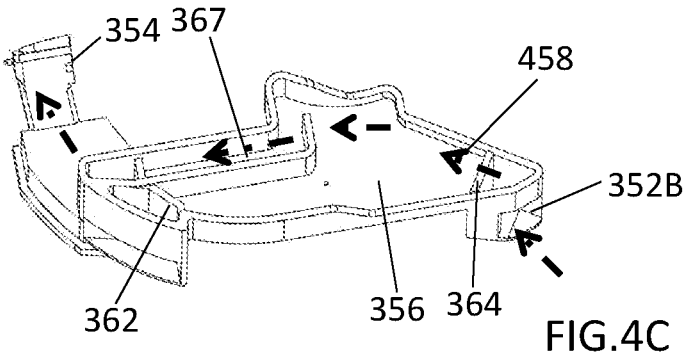

FIG. 4C shows the refrigerant flow path in the suction muffler according a first embodiment of the present invention when assembled in the second configuration. As shown in FIG. 4C, the rear internal wall 367 is provided which runs parallel to the back of the first housing portion 360. The refrigerant flow path 458 runs through the second inlet opening 352B, and into the muffling space 356 through the gap over the second inlet opening wall 364. The refrigerant flow path 458 runs through the muffling space 356 into a channel formed by the rear internal wall 367 and out of the suction muffler outlet 354.

As described above, the first configuration and the second configuration of the suction muffler according to the first embodiment can be assembled using a common part which forms the muffler body. An interchangeable muffler cover part is combined with the common part to form either the first configuration or the second configuration.

Figure 5A:
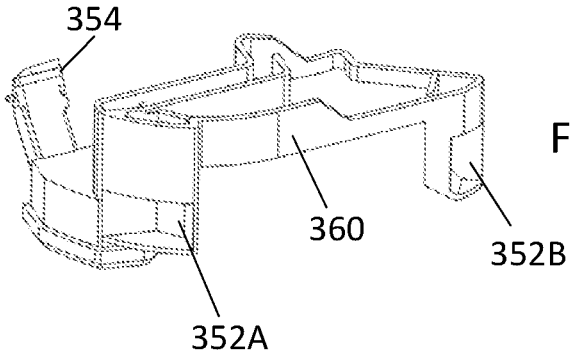
FIG. 5A shows a part common to the first configuration and the second configuration of a suction muffler according to a first embodiment of the present invention.

FIG. 5A shows a part common to the first configuration and the second configuration of a suction muffler according to a first embodiment of the present invention. The common part is the first housing portion 360 which forms the body of the suction muffler 350 and as a first inlet opening 352A, a second inlet opening 352B and a suction muffler outlet 354.

Figure 5B:
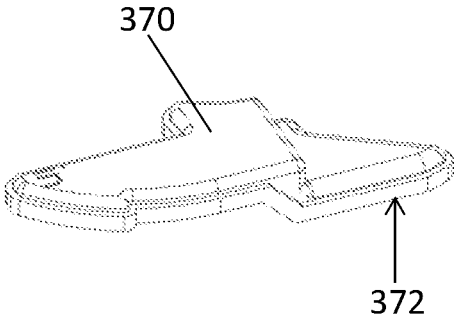
FIG. 5B shows an interchangeable part used assembly of a first configuration of a suction muffler according to a first embodiment of the present invention.

FIG. 5B shows an interchangeable part used assembly of a first configuration of a suction muffler according to a first embodiment of the present invention. The interchangeable part used in the first configuration is the second housing portion 370 which forms the muffler cover and has a blocking member 372 located in the vicinity of the second inlet opening 352B. The blocking member 372 is configured to block a second refrigerant path from the second inlet opening 352B to the suction muffler outlet 354.

Figure 5C:
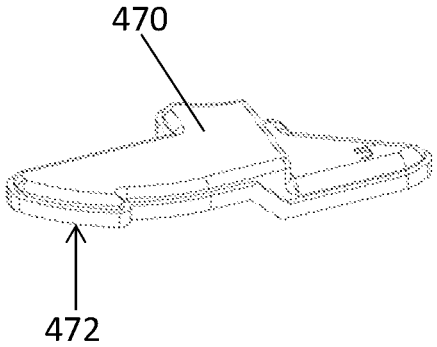
FIG. 5C shows an interchangeable part used assembly of a second configuration of a suction muffler according to a first embodiment of the present invention.

FIG. 5C shows an interchangeable part used assembly of a second configuration of a suction muffler according to a first embodiment of the present invention. The interchangeable part used in the second configuration is the second housing portion 470 which forms the muffler cover and has a blocking member 472 located in the vicinity of the first inlet opening 352A. The blocking member 472 is configured to block a first refrigerant path from the first inlet opening 352A to the suction muffler outlet 354.

Figure 6A:
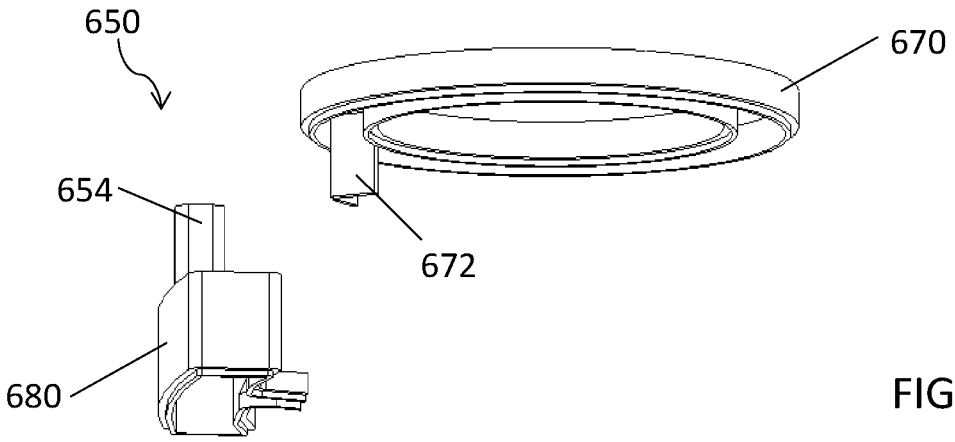
FIG. 6A shows component parts of a suction muffler according to a second embodiment of the present invention.
Figure 6B:
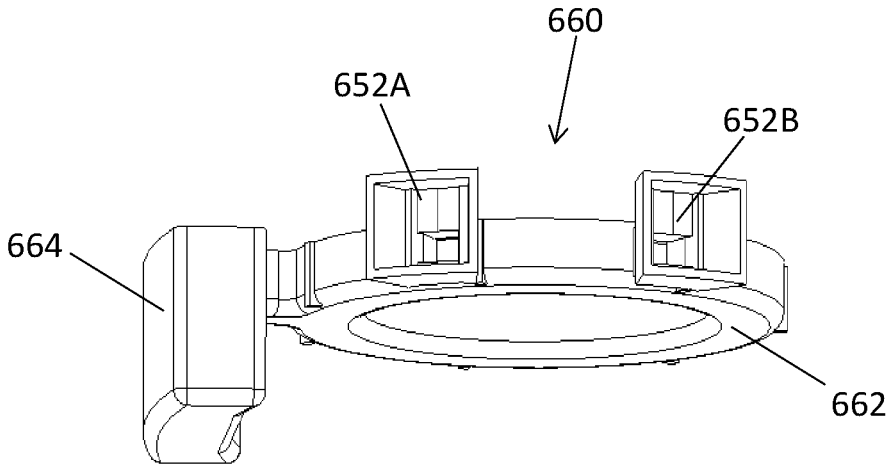
FIG. 6B shows an assembled suction muffler according to a second embodiment of the present invention.
Figure 6B:
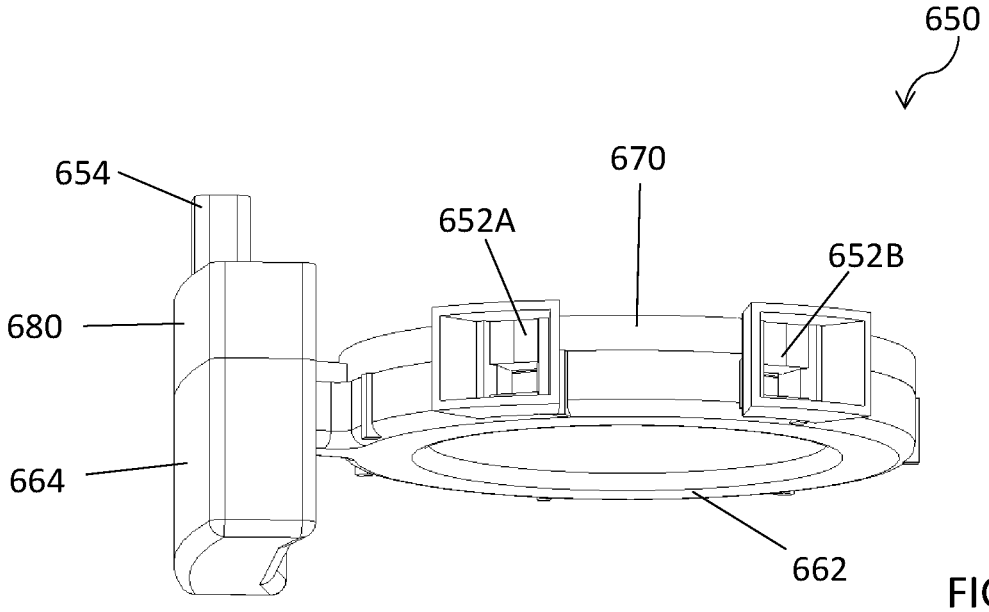

FIG. 6A and FIG. 6B show a suction muffler according to a second embodiment of the present invention. In the first embodiment of the present invention, a refrigerant flow path can be selectively blocked by the selection of a second housing portion from a plurality of selectable second housing portions. In the second embodiment, the second housing portion can be joined to the first housing portion in a plurality of different configurations. Thus, the relative positioning of the first housing portion and the second housing portion determines the selective blocking of refrigerant flow paths.

FIG. 6A shows component parts of a suction muffler according to a second embodiment of the present invention. As shown in FIG. 6A, the suction muffler 650 comprises three component parts: a first housing portion 660, a second housing portion 370 and a third housing portion 680.

The first housing portion 660 comprises a ring shaped channel body 662. A first inlet opening 652A and a second inlet opening 652*b* open from the ring shaped channel body 662. The ring shaped channel body 662 is connected to a chamber body 664. The second housing portion 670 forms a ring shaped cover for the ring shaped channel body 662. A blocking member protrudes downwards from the second housing portion 670. The third housing portion 680 forms a cover for the chamber body 664. The third housing portion 680 comprises a suction muffler outlet 654.

FIG. 6B shows an assembled suction muffler according to a second embodiment of the present invention. As shown in FIG. 6B, the second housing portion 670 is attached to the first housing portion 660 and covers the ring shaped channel body 662, thus forming a ring shaped channel. The third housing portion 680 is attached to the first housing portion 660 and covers the chamber body 664, thus forming a muffler chamber. The suction muffler outlet 654 extends from the muffler chamber. The first outlet opening 652A and the second outlet opening 652B open from the ring shaped channel formed by the ring shaped channel body 662 and the second housing portion 670. The first housing portion 660, the second housing portion 370 and the third housing portion 680 may be attached by adhesive or welding, for example.

Depending on the relative rotational positioning of the first housing portion 660 and the second housing portion 670, the blocking member 672 may block the ring shaped channel and/or one of the first outlet opening 652A and the second outlet opening 652B. Examples of different configurations are shown in FIG. 8A to FIG. 8D.

Figure 7:
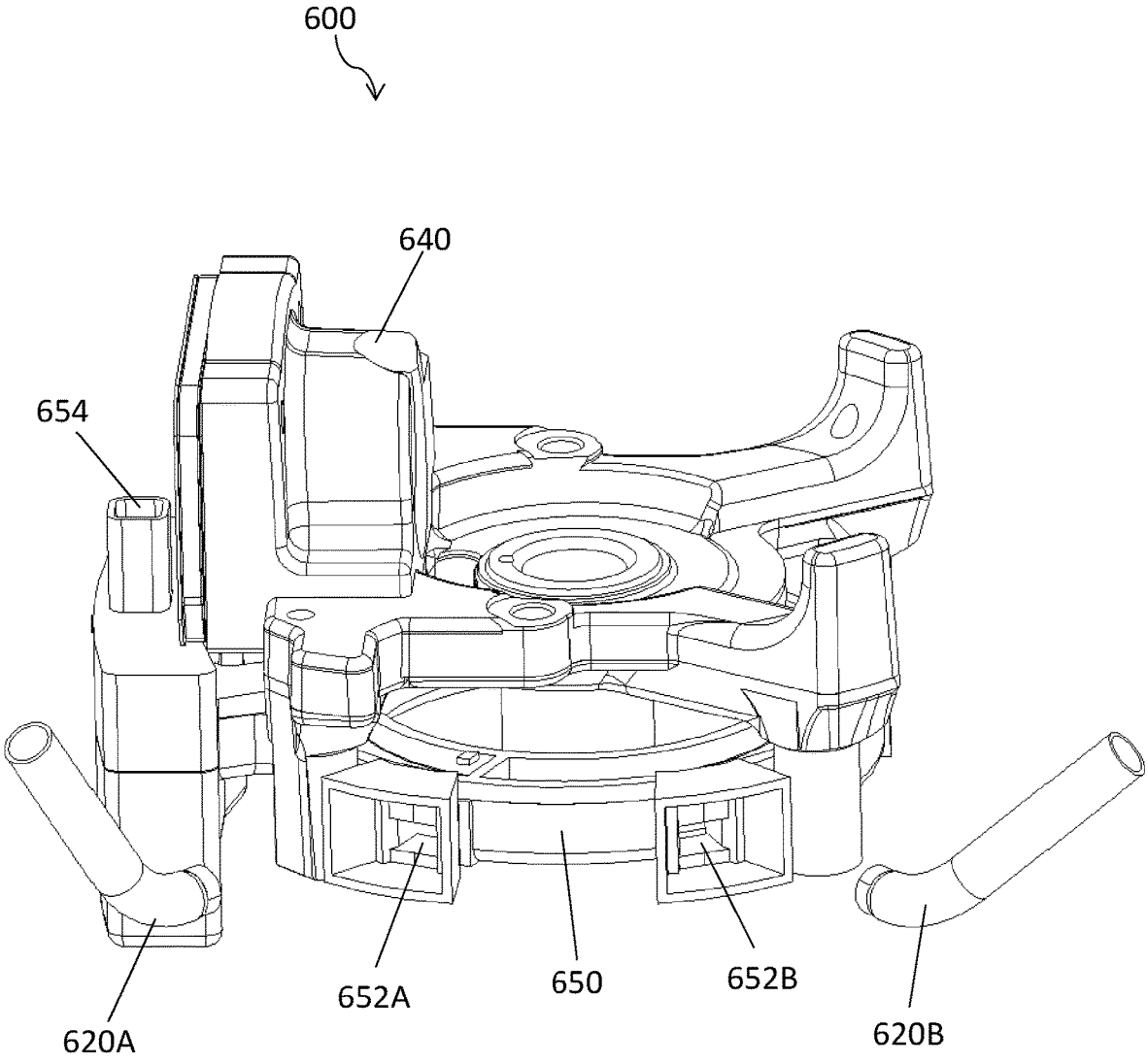
FIG. 7 shows a cut away view of a reciprocating compressor comprising a suction muffler according to a second embodiment of the present invention.

FIG. 7 shows a cut away view of a reciprocating compressor comprising a suction muffler according to a second embodiment of the present invention. As shown in FIG. 7, the reciprocating compressor 600 comprises the suction muffler 650. The ring shaped channel of the suction muffler 650 is arranged beneath the compression component 640 of the reciprocating compressor 600. The ring shaped channel of the suction muffler is arranged around the electromotive component of the reciprocating compressor 600. This prevents noise generated by the electromotive element from passing to the shell of the reciprocating compressor 600.

As shown in FIG. 7, the first outlet opening 652A and the second outlet opening 652B are arranged in positions facing a first suction pipe position 620A and a second suction pipe position 620B, respectively. As in the first embodiment described above, due to design requirements of the reciprocating compressor 600, the suction pipe of the reciprocating compressor may be placed at either of the first suction pipe position 620A and the second suction pipe position 620B.

In some embodiments, two suction pipes may be provided with one suction pipe at the first suction pipe position 620A and a second suction pipe at the second suction pipe position 620B.

As shown in FIG. 7, the suction muffler outlet 654 is communicatively coupled to the compression component 640 of the reciprocating compressor 600.

Figure 8A:
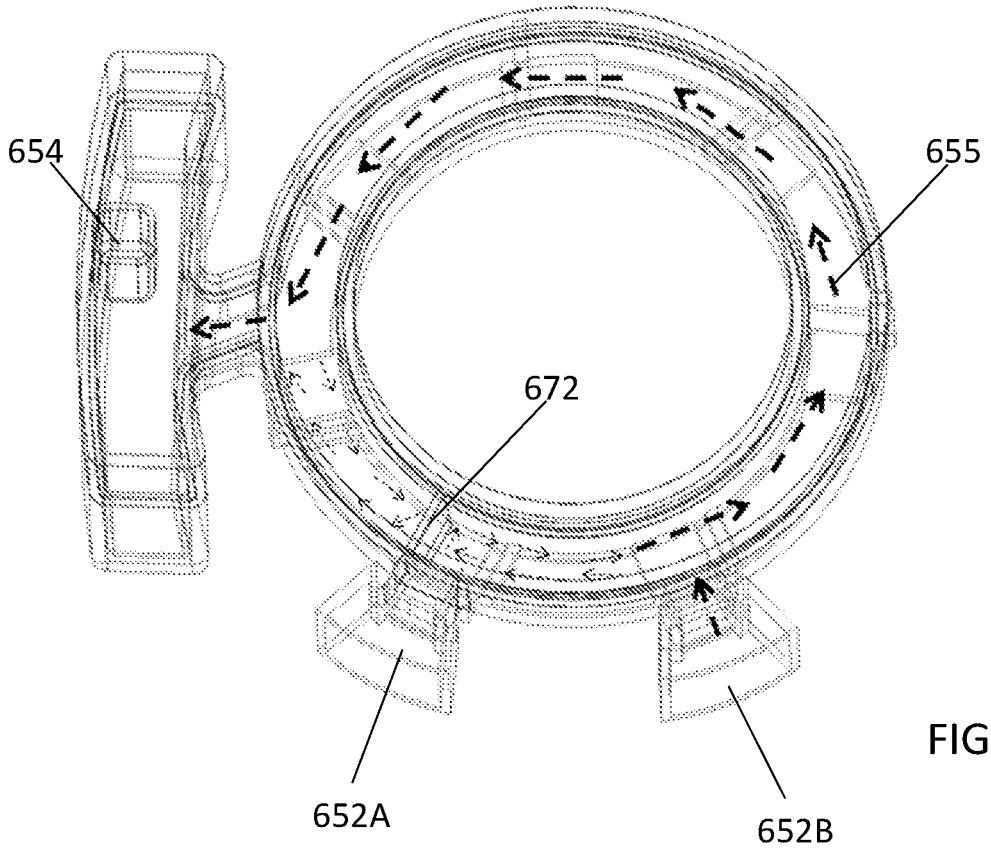
FIG. 8A shows a suction muffler according to a second embodiment of the present invention assembled in a first configuration.

FIG. 8A shows a suction muffler according to a second embodiment of the present invention assembled in a first configuration. In the first configuration as shown in FIG. 8A, the second housing portion 670 is attached to the first housing portion 660 in a rotational position in which the blocking member 672 is located adjacent to the first inlet opening 652A. Thus, the blocking member 672 blocks refrigerant flow through the first inlet opening 652A and also blocks refrigerant flow along a flow path that runs past the first inlet opening 652A. In the first configuration, refrigerant can flow along a second refrigerant flow path 655 which runs from the second inlet opening 652B to the suction muffler outlet 654 around the ring shaped channel. Thus, in the first configuration, the second inlet opening 652B functions as the suction muffler inlet.

Figure 8B:
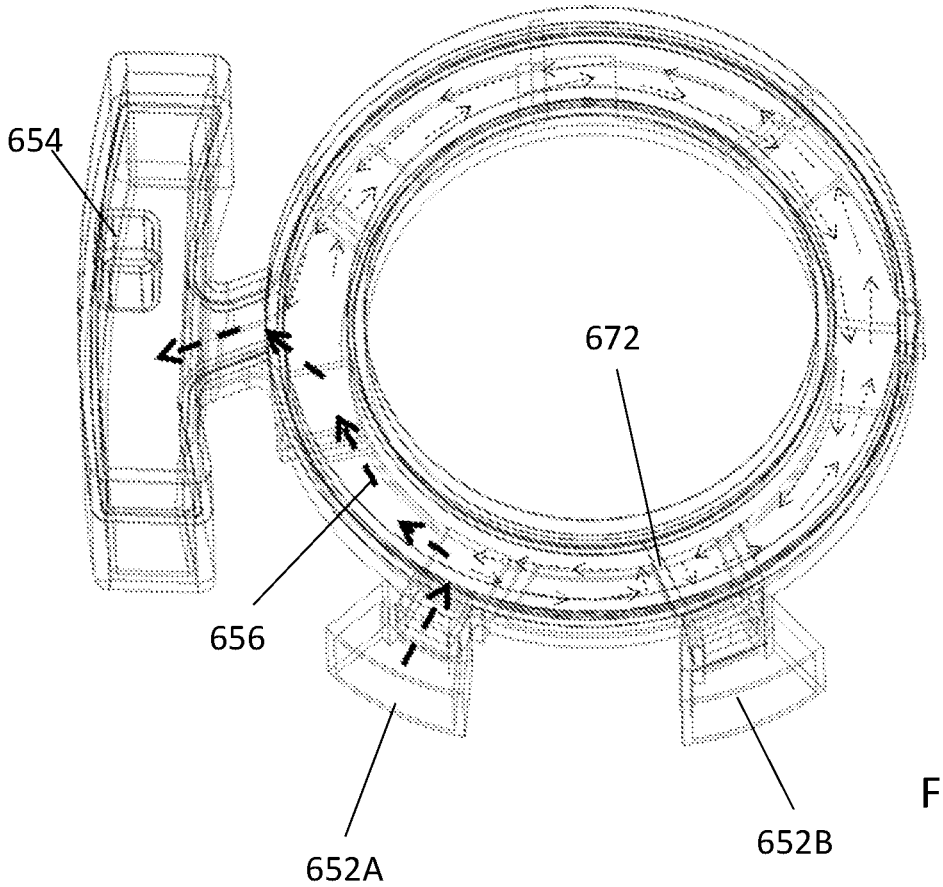
FIG. 8B shows a suction muffler according to a second embodiment of the present invention assembled in a second configuration.

FIG. 8B shows a suction muffler according to a second embodiment of the present invention assembled in a second configuration. In the second configuration, as shown in FIG. 8B, the second housing portion 670 is attached to the first housing portion 660 in a rotational position in which the blocking member 672 is located adjacent to the second inlet opening 652B. Thus, the blocking member 672 blocks refrigerant flow through the second inlet opening 652B and also blocks refrigerant flow along a flow path that runs second the first inlet opening 652B. In the second configuration, refrigerant can flow along a first refrigerant flow path 656 which runs from the first inlet opening 652A to the suction muffler outlet 654 around the ring shaped channel. Thus, in the second configuration, the first inlet opening 652A functions as the suction muffler inlet.

Figure 8C:
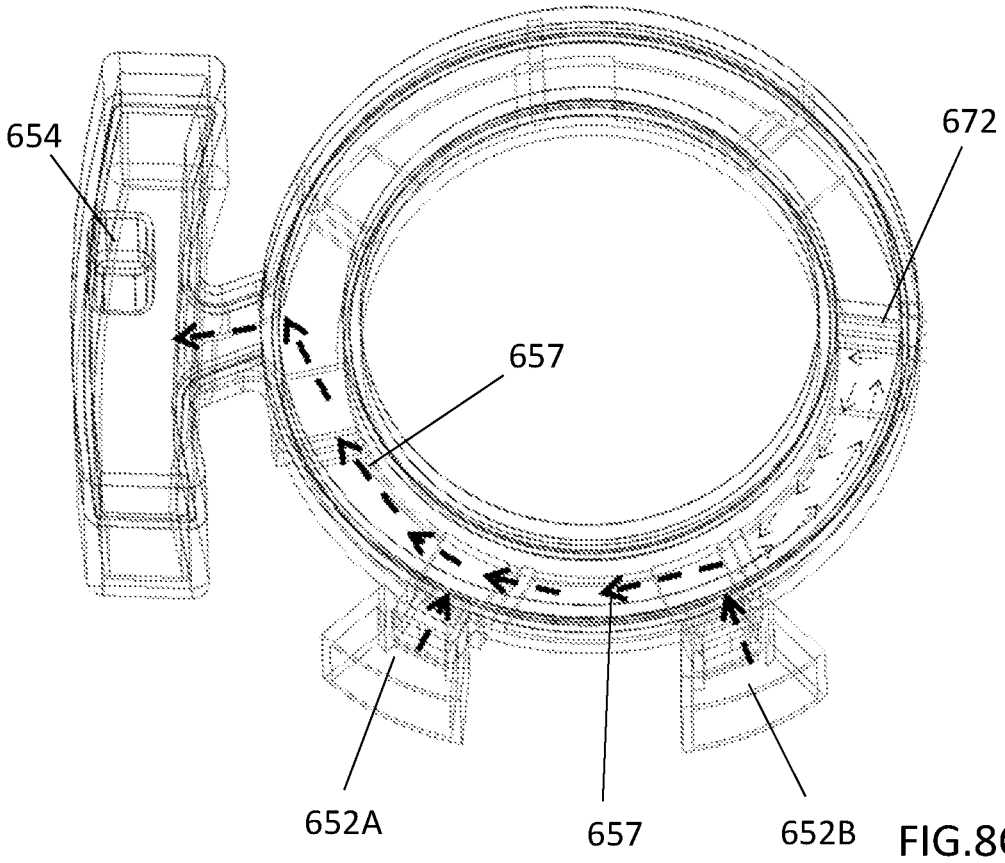
FIG. 8C shows a suction muffler according to a second embodiment of the present invention assembled in a third configuration.

FIG. 8C shows a suction muffler according to a second embodiment of the present invention assembled in a third configuration. In the third configuration, as shown in FIG. 8C, the second housing portion 670 is attached to the first housing portion 660 in a rotational position in which the blocking member 672 is located at a point opposite the muffler chamber. Thus, the blocking member 672 blocks refrigerant flow around the ring shaped channel, but does not block either of the first inlet opening 652A or the second inlet opening 652B. In the third configuration, refrigerant can flow along a third refrigerant flow path 657 which runs from the second inlet opening 652B along the ring shaped channel, past the first inlet opening 652A to the suction muffler outlet 654. In the third configuration, both the first inlet opening 652A and the second inlet opening 652B function as the suction muffler inlet. It is noted that in the third configuration, a refrigerant flow path from the second inlet opening 652B around the ring in the direction that does not pass the first inlet opening 652A is blocked.

Figure 8D:
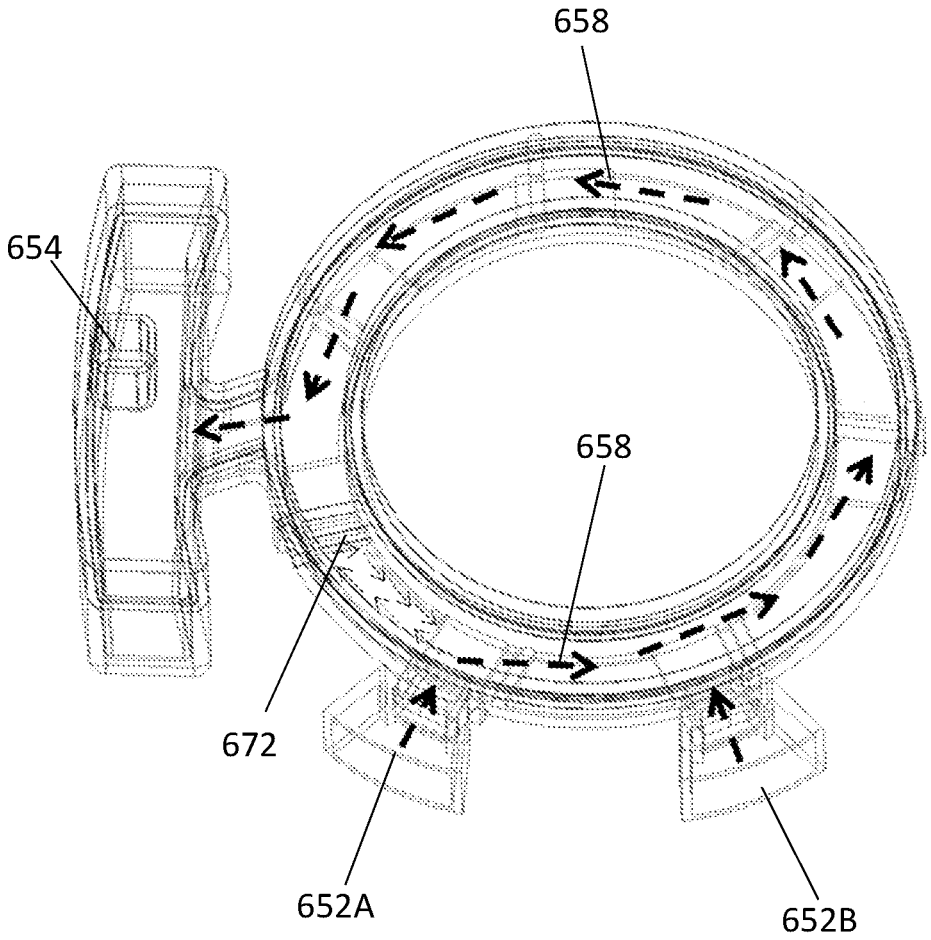
FIG. 8D shows a suction muffler according to a second embodiment of the present invention assembled in a fourth configuration.

FIG. 8D shows a suction muffler according to a second embodiment of the present invention assembled in a fourth configuration. In the fourth configuration, as shown in FIG. 8D, the second housing portion 670 is attached to the first housing portion 660 in a rotational position in which the blocking member 672 is located at a point close to the muffler chamber. Thus, the blocking member 672 blocks refrigerant flow around the ring shaped channel from the first inlet opening towards the muffler chamber, but does not block either of the first inlet opening 652A or the second inlet opening 652B. In the fourth configuration, refrigerant can flow along a fourth refrigerant flow path 658 which runs from the first inlet opening 652A along the ring shaped channel, past the second inlet opening 652B to the suction muffler outlet 654. In the fourth configuration, both the first inlet opening 652A and the second inlet opening 652B function as the suction muffler inlet.

Whilst the foregoing description has described exemplary embodiments, it will be understood by those skilled in the art that many variations of the embodiments can be made within the scope and spirit of the present invention.

The invention claimed is:

1. A suction muffler for a reciprocating compressor, the suction muffler comprising:

a first housing portion comprising a first inlet opening, and a second inlet opening, wherein the first inlet opening and/or the second inlet opening is configured to receive refrigerant from a suction pipe of the reciprocating compressor; and a second housing portion comprising a blocking member configured to block one of a first refrigerant flow path from the first inlet opening to a suction muffler outlet, and a second refrigerant flow path from the second inlet opening to the suction muffler outlet, the suction muffler outlet being configured to couple to a compression component of the reciprocating compressor.

2. The suction muffler according to claim 1, wherein second housing portion is selected from a plurality of possible second housing portions, the plurality of possible second housing portions having blocking members provided in different configurations.

3. The suction muffler according to claim 1, wherein the second housing portion is attachable to the first housing portion in a plurality of different configurations.

4. The suction muffler according to claim 1, wherein the blocking member is configured to block either the first inlet opening or the second inlet opening.

5. The Suction muffler according to claim 1, wherein the first housing portion comprises a ring shaped portion comprising two potential refrigerant flow paths from the first inlet opening to the suction muffler outlet and two possible flow paths from the second inlet opening to the suction muffler outlet and wherein the blocking member is configured to block one of the potential paths from the first inlet opening to the suction muffler outlet and one of the potential paths from the second inlet opening to the suction muffler outlet.

6. The suction muffler according to claim 1, wherein the first housing portion comprises the suction muffler outlet.

7. The suction muffler according to claim 1, wherein the first housing portion is a muffler body portion.

8. The suction muffler according to claim 1, wherein the second housing portion is a muffler cover portion.

9. The reciprocating compressor comprising a suction muffler according to claim 1.

10. The reciprocating compressor according to claim 9, wherein the suction muffler comprises a ring shaped channel portion arranged around an electromotive element of the reciprocating compressor.

* * * * *